United States Patent [19]

von Valtier

[11] 4,114,499

[45] Sep. 19, 1978

[54] METHOD AND APPARATUS FOR SECURING VIBRATO AND TREMOLO EFFECTS

[76] Inventor: Eric von Valtier, 521 Leicester, Plymouth, Mich. 48179

[21] Appl. No.: 763,021

[22] Filed: Jan. 27, 1977

[51] Int. Cl.[2] ..... G10H 1/04

[52] U.S. Cl. ..... 84/1.25; 84/1.24; 179/1 J

[58] Field of Search ..... 84/1.24, 1.25; 179/1 J; 330/69

[56] References Cited

U.S. PATENT DOCUMENTS

| | | | |
|---|---|---|---|
| 2,835,814 | 5/1958 | Dorf | 84/1.25 |
| 3,875,522 | 4/1975 | Hoefi | 330/69 |
| 3,921,091 | 11/1975 | Van Kessel | 330/69 |
| 3,945,290 | 3/1976 | Dittmar | 84/1.25 |
| 4,000,676 | 1/1977 | Love | 179/1 J |
| 4,047,119 | 9/1977 | Ohmuru | 330/69 |

*Primary Examiner*—Robert K. Schaefer
*Assistant Examiner*—Leonard W. Pojunas, Jr.
*Attorney, Agent, or Firm*—Barnes, Kisselle, Raisch & Choate

[57] ABSTRACT

Method and apparatus for securing vibrato and tremolo effects in musical instruments, such as electronic organs, wherein an incoming electrical signal is separated into high and low frequency components which are injected into opposite ends of a multiple-tap delay line. Analog multiplexers are connected to the line and are addressed to scan the delay line terminals sequentially in both directions. In a preferred embodiment, the duty cycles of high frequency sampling signals connected to enable the output of each multiplexer are modulated to secure a smooth transition in a composite output signal between the signals appearing at successive delay line terminals. Alternative methods and apparatus for blending successively scanned delay line signals are also disclosed.

41 Claims, 4 Drawing Figures

HIGH FREQ. OSC.
10
PULSE WIDTH MOD.
12
13
LOW FREQ. OSC.
14
16
18
+V
20
22
COUNTER
24
ADDER
26
32
33
ANALOG MULTIPLEXER
28
ANALOG MULTIPLEXER
30
ENA
ENA
LOW PASS FILTER
50
52
OUTPUT
48a
48b
48c
48d
48e
48f
48g
48h
48i
48
44
46
40
42
L.F.
H.F.
CROSSOVER NETWORK
38
INPUT
36

METHOD AND APPARATUS FOR SECURING VIBRATO AND TREMOLO EFFECTS

The present invention relates to electronic scanning systems and methods, and more particularly to systems and methods for securing vibrato and/or tremolo effects in electronic musical instruments or the like.

Prior art vibrato- and tremolo-effect systems have been generally designed for incorporation into electronic musical instruments, such as organs, at the time of instrument manufacture. In such an environment the cost of the vibrato system is of little significance as compared to the cost of the instrument as a whole. Accordingly, relatively expensive mechanical systems, such as rotating speakers, and electromechanical systems, such as multiple-tap delay lines scanned by rotating capacitors, have been adopted and widely used. Systems of the latter type are exemplified by U.S. Pat. No. 3,258,519. However, the high cost, the unreliability caused by a multiplicity of moving parts and the relative complexity of such systems have rendered them unsatisfactory for sale and use in the musical instrument aftermarket. Prior art attempts to incorporate advanced electronics into vibrato systems and methods, exemplified by U.S. Pat. No. 3,945,290, have generally resulted in complex apparatus which have not been cost effective.

It is an object of the present invention to provide a method and apparatus for securing vibrato and tremolo effects which may be economically manufactured for the musical instrument aftermarket, and which may be readily and rapidly installed into a pre-existing instrument by a relatively unskilled purchaser.

In furtherance of the above, it is another object of the invention to provide a method for scanning a multiple-tap electrical delay line which may be carried out using advanced commercially available electronics, particularly integrated digital electronics, and to provide an economical and reliable all-electronic apparatus which incorporates such method.

It is a further object of the invention to provide a vibrato method and apparatus which secures an enhanced tremolo effect.

Yet another object of the invention is to provide a variable gain amplifier for achieving a desired blend of two input signals and which has specific application in systems for securing vibrato effects.

The present invention, together with additional objects, features and advantages thereof, will be best understood from the following description when read in conjunction with the accompanying drawings in which.

Figure 1:
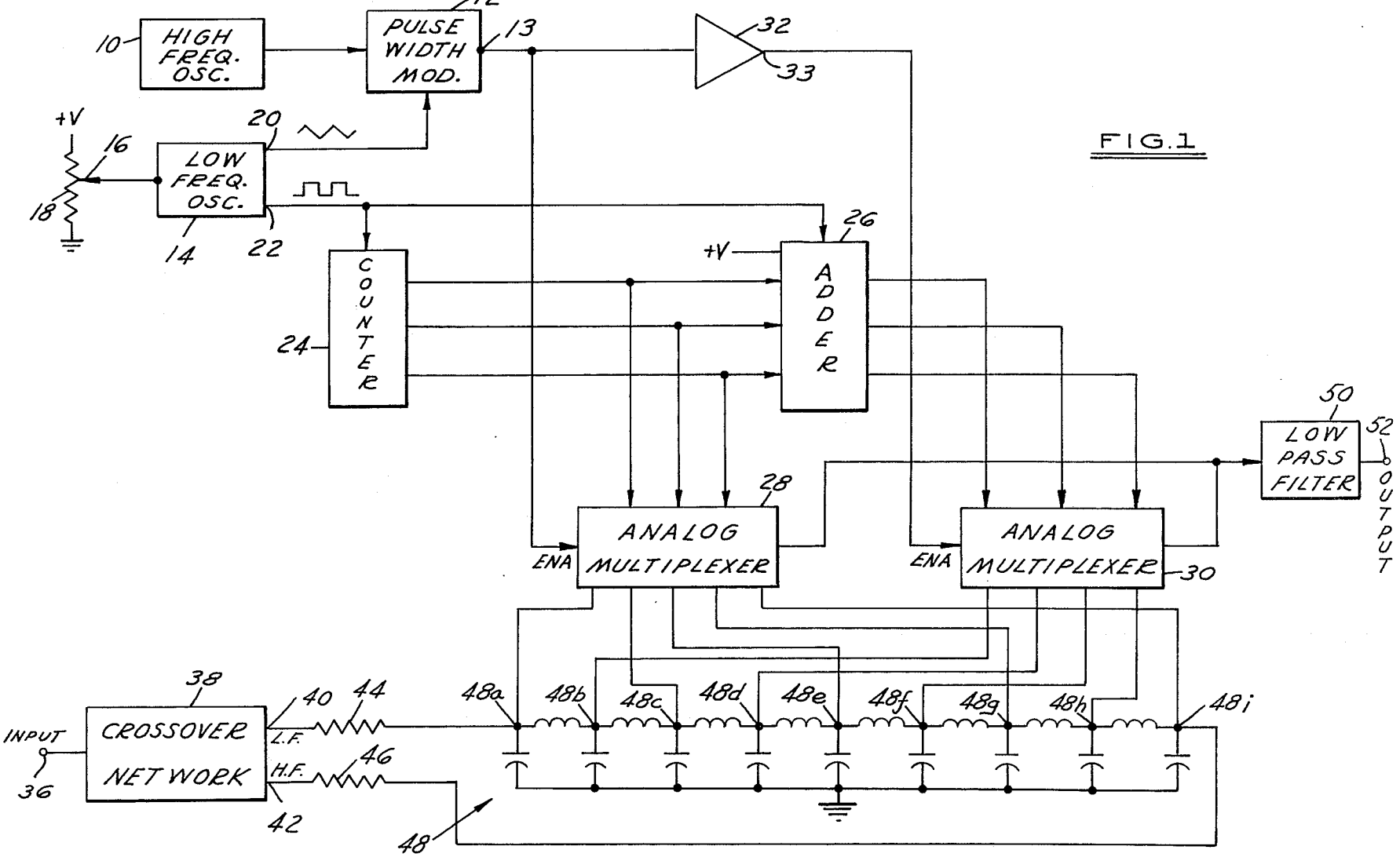
FIG. 1 is a functional block diagram of a presently preferred embodiment of the invention.

Referring to FIG. 1, a high frequency oscillator 10 has an output connected to one input of a pulse width modulator 12. A voltage controlled low frequency oscillator 14 has a control input connected to the slide wire 16 of a variable resistor 18 which is connected between a positive voltage source and ground. Oscillator 14 has a first output 20 which feeds a signal to a second input of pulse width modulator 12 of symmetrical triangular waveform (FIG. 2), i.e., output 20 rises with a uniform linear positive slope to a peak during a positive-going half cycle and then decreases to zero with a complementary uniform linear regating slope during a negative-going half cycle of equal duration. A second output 22 from oscillator 14 supplies a square wave signal to the clock inputs of a three-bit binary counter 24 and a four-bit binary adder 26. Modulator 12 provides a signal at its output 13 having the frequency of oscillator 10 and a duty cycle controlled by oscillator output 20. The three data outputs of counter 24 are respectively connected to corresponding address inputs of an analog multiplexer 28 and to the two-, three- and four-bit inputs of adder 26. The one-bit input of adder 26 is connected to the positive voltage source, whereby adder 26 adds a binary one to the collective output of counter 24 whenever a clock signal is received from oscillator output 22. The two-, three- and four-bit data outputs of adder 26 are respectively connected to the first, second and third address inputs of a second analog multiplexer 30, the one-bit output of adder 26 being open. Output 13 of pulse width modulator 12 is connected directly to the enable input of multiplexer 28, and is connected to an inverter 32 which has an output 33 fed to the enable input of multiplexer 30.

A frequency-selecting crossover network 38 comprising suitable high- and low-pass filters has an input connected to a terminal 36 which comprises the electrical signal input to the embodiment of FIG. 1. Network 38 has a low frequency output 40 and a high frequency output 42 connected through respective resistors 44, 46 to opposite ends of a conventional inductance-capacitance multiple-segment delay line 48. In a working embodiment of the invention, a delay line 48 manufactured by Yorkville Sound Ltd. of Toronto, Canada, part number 1478, has provided satisfactory results. In the embodiment of FIG. 1, delay line 48 has nine terminals 48*a*–48*i* (including end terminals) separating the line segments at which the signals fed into line end terminals 48*a*, 48*i* appear in succession after cumulative delay, phase shift and attenuation. Delay line terminals 48*a*, 48*c*, 48*e*, 48*g* and 48*i* are connected to the data input terminals or input channels of multiplexers 28 such that, for binary address counts zero through seven from counter 24, multiplexer 28 scans the delay line terminals in the following sequence: 48*a*, 48*c*, 48*e*, 48*g*, 48*i*, 48*g*, 48*e*, 48*c*. Using a standard eight-channel multiplexer this may be accomplished by connecting terminal 48*a* to input channel one, terminal 48*c* to input channels two and eight, terminal 48*e* to channels three and seven, terminal 48*g* to channels four and six, and terminal 48*i* to channel five. Similarly, delay line terminals 48*b*, 48*d*, 48*f* and 48*h* are connected to the data inputs of multiplexer 30 such that, for binary address counts zero through seven from adder 26, multiplexer 30 scans the delay line terminals in the following sequence: 48*b*, 48*b*, 48*d*, 48*f*, 48*h*, 48*f*, 48*d*. Again, using a standard eight channel multiplexer, terminals 48*b*, 48*d*, 48*f* and 48*h* are connected to input channels one and two, three and eight, four and seven, and five and six respectively. The scanning sequence and the generation of vibrato and tremolo effects will be discussed in detail hereinafter in connection with FIG. 2. A low pass filter 50 has an input connected to the outputs of both multiplexers 28, 30 and an output, which comprises the output of the embodiment of FIG. 1, connected to a terminal 52.

Figure 2:
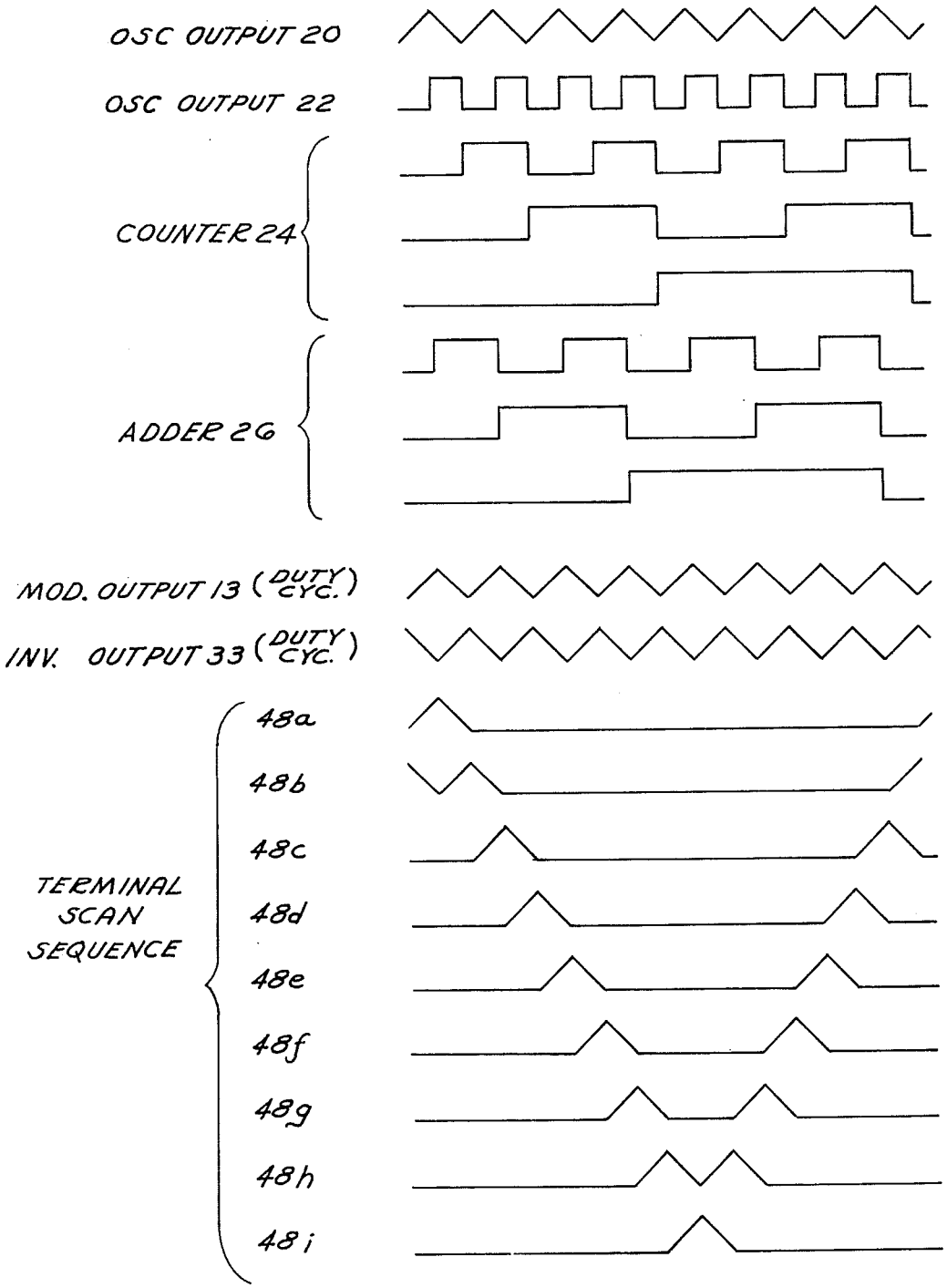
FIG. 2 is a timing diagram useful in understanding the operation of the embodiment of FIG. 1.

Operational details of the method and apparatus illustrated in FIG. 1 will be best understood with reference to FIG. 2 which is a timing diagram depicting relationships between various signals which appear in FIG. 1 during one vibrato cycle. A vibrato cycle may be defined as a complete scan of delay line 48 in both directions. For purposes of the discussion herein, a vibrato cycle will be considered to begin with the scanning of terminal 48*a*. The upper eight signals in FIG. 2 respectively illustrate oscillator output 20, oscillator output 22, the three address inputs to multiplexer 28 from counter 24 and the three address inputs to multiplexer 30 from adder 26. The next two signals in FIG. 2 respectively illustrate the duty cycle of output 13 from pulse width modulator 12 and the duty cycle of output 33 from inverter 32. The nine lower signals in FIG. 2 illustrate not only the sequence in which delay line terminals 48*a*–48*i* are scanned, but also the percentage of the output signal sampled from each terminal at any point in time during the vibrato cycle.

For purposes of illustration, it is assumed that the counts in counter 24 and adder 26 are initially zero. At such time, delay line terminal 48*a* will be gated to the output of multiplexer 28 and terminal 48*b* will be gated to the output of multiplexer 30 whenever the respective multiplexers receive an enable input. During the rising half-cycle of oscillator output 20, the duty cycle of modulator output 13 increases from zero to one hundred precent and the duty cycle of inverter output 33 decreases correspondingly. Thus, the enable signal to multiplexer 28 is on for a progressively increasing percentage of time, while the percentage of time during which multiplexer 30 is enabled correspondingly decreases. This complementary transition in the enable signals to the modulators affects a progressively increased sampling of delay line terminal 48*a* and a correspondingly decreased sampling of terminal 48*b*, and thereby achieves a smooth transition at the input of filter 50 between the signals appearing at the two terminals. It will be appreciated, of course, that because of inverter 32, multiplexers 28, 30 are never enabled simultaneously.

The leading edge of oscillator output 22 clocks adder 26, such that the address fed to multiplexer 30 is incremented to a logical one. As noted above, this address also corresponds to line terminal 48*b*. Thus, during the decreasing half-cycle of oscillator output 20, the sampling enable signals to the multiplexers undergo a smooth transition in the reverse direction and a correspondingly smooth transition is affected at the intput to filer 50 from the signal at line terminal 48*a* to that at 48*b*. On the trailing edge of oscillator output 22, counter 24 is incremented and terminal 48*c* is addressed in multiplexer 28. Thus, during the next rising half-cycle of oscillator output 20, the signal at terminal 48*c* is increasingly sampled and the signal at terminal 48*b* is decreasingly sampled to effect a smooth transition at filter 50. As adder 26 and counter 24 are further progressively incremented, the delay line is scanned in the following transition sequence: 48*c* to 48*d*, 48*d* to 48*e*, . . . 48*h* to 48*i*, 48*i* to 48*h*, . . . 48*c* to 48*b*, which completes the vibrato cycle. Filter 50 removes the sampling noise from the output signal.

Although the preferred embodiment of the invention hereinabove described is seemingly complex, as a matter of fact such embodiment can be fabricated with MSI and LSI electronic packages presently available using only seven integrated circuits and two to three dozen discrete components in addition to the delay line. Indeed, the preferred embodiment so described is considered to present a very advantageous cost-to-function ratio. Moreover, it will be evident that the preferred embodiment is both more economical and more reliable than mechanical, electromechanical and electronic vibrato systems proposed in the prior art. When produced as a package for the musical instrument aftermarket, the disclosed system may be readily installed by unskilled purchasers by merely disconnecting the existing amplifier-speaker conductor from the speaker and then connecting such conductor to input terminal 36. An additional conductor is then connected from output terminal 52 to the speaker, and resistor 18 is adjusted by trial-and-error to achieve a vibrato frequency considered to produce the most pleasing results. It may also be noted that the method and apparatus provided herein is not limited to musical instrument applications, but may also be used to produce pleasant effects in home and automobile radio systems or the like.

In addition to the obvious advantages of economy, reliability and ease of installation discussed immediately above, the preferred embodiment of the invention possesses significant, perhaps more subtle, advantages. For example, it has been recognized in accordance with the invention that the separation of the incoming signal into high and low frequency segments and the injection of these components into opposite ends of the delay line produces interesting and pleasant vibrato and tremolo effects. The delay and phase shift imparted to the signals by each segment of the delay line is dependent on signal frequency. Thus, injection of high and low frequency signals into opposite ends of the delay line increases the randomness of the various frequency components thereof at each delay line terminal and also results in vibrato sampling of high and low frequency signal components in opposite directions, thereby enhancing the vibrato effect. The frequency separation, coupled with the fact that the delay line is not terminated at either end in its characteristic impedance, also permits random standing wave patterns to develop, thereby randomly attenuating the signals as they appear at each delay line terminal to yield an enhanced tremolo effect. In one working embodiment of the invention wherein the frequency separation in network 38 occurred at seven hundred fifty hertz, interesting and pleasant vibrato and tremolo effects were produced.

It will also be apparent that the preferred embodiment of the invention may be economically packaged as an aftermarket component for electronic musical instruments, and is also useful and adaptable for inclusion in an instrument during original manufacture thereof. In the latter alternative, vibrato frequency control resistor 18 may advantageously be replaced by more sophisticated and well known vibrato control circuitry. The frequency of oscillator 14 may range from zero to 100 hertz. In this vibrato frequency range, a sampling frequency at oscillator 10 of 75 kilohertz is preferred. Other vibrato and sampling frequencies may also be used. Similarly, an eight-segment delay line is presently preferred as presenting an advantageous trade-off between vibrato effect and manufacturing cost, particularly since the adder and multiplexers are conveniently packaged as described hereinabove. However, more or fewer delay line segments may be used where desired. As another modification, switch gates or the like may be provided at the outputs of multiplexers 28, 30 in FIG. 1 with respective gating inputs connected to modulator 12 and inverter 32. However, the use of commercially available multiplexer packages which have enable inputs permits the function of such switching gates to be performed without incurring the additional cost thereof.

Figure 3:
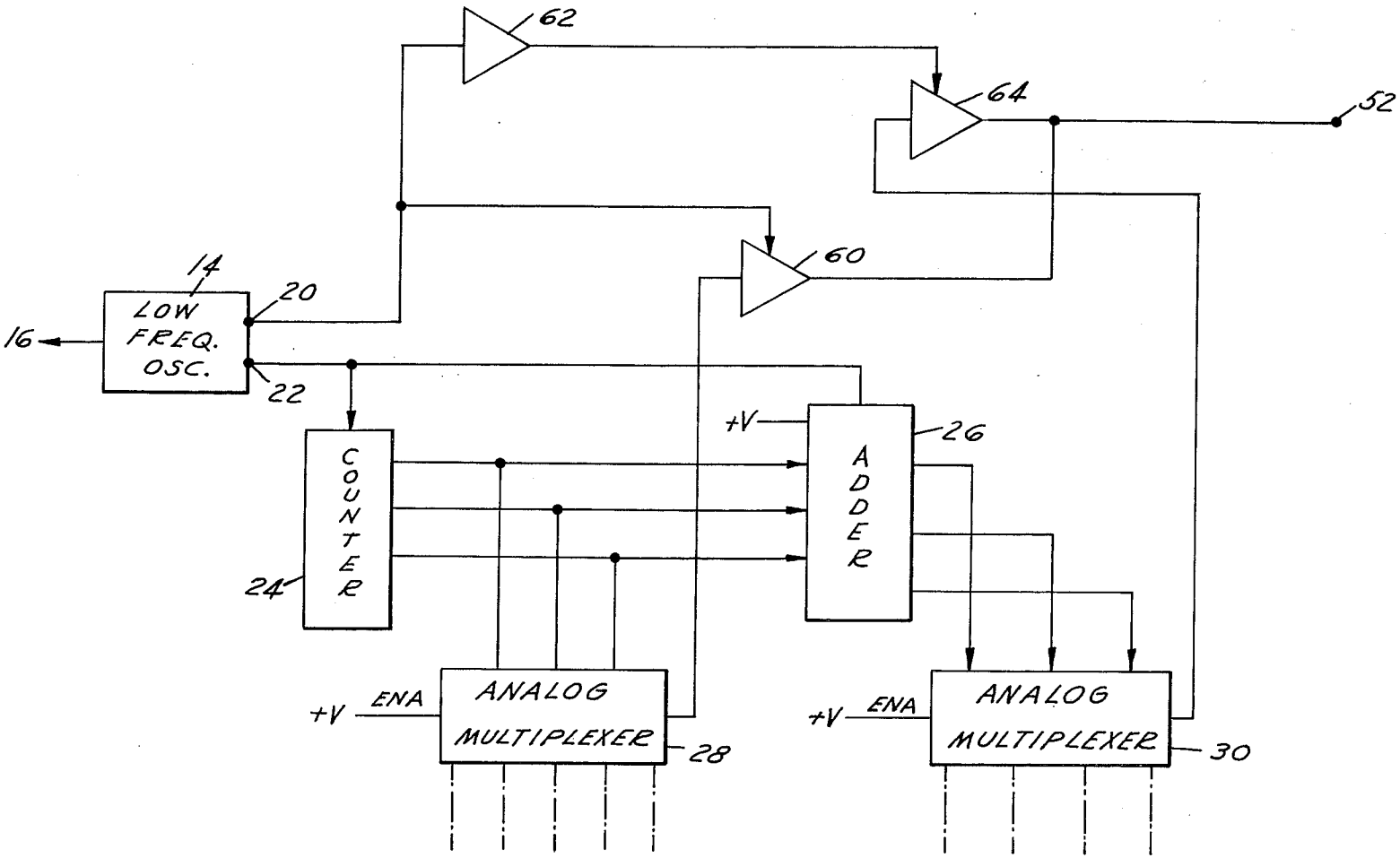
FIG. 3 is a functional block diagram of a modification to the preferred embodiment of FIG. 1.

FIG. 3 illustrates a second embodiment of the present invention wherein the sampling oscillator 10 and accompanying circuitry have been replaced by alternative means for blending the signals at successive delay line terminals as the delay line is scanned. More specifically, referring to FIG. 3, vibrato oscillator output 20 is connected directly to the control intput of a first variable gain voltage-controlled amplifier 60 and through an inverter 62 to the control input of a second variable gain voltage-controlled amplifier 64. The outputs of multiplexers 28, 30 are respectively connected to the signal inputs of controlled amplifiers 60, 64. The outputs of amplifiers 60, 64 are connected together at output terminal 52. The enable inputs of multiplexers 28, 30 are connected to the voltage source so that the multiplexers are continuously enabled. The interconnections of oscillator 22, counter 24, adder 26, multiplexers 28, 30 and delay line 48 (FIG. 1) are identical to those in FIG. 1 and need not be further discussed. It will be evident that, in the operation of the embodiment of FIG. 3, oscillator output 20 and controlled amplifiers 60, 64 effect a smooth transition between the multiplexer outputs. The embodiment of FIG. 3 eliminates the need for oscillator 10, modulator 12 and sampling noise suppression filter 50 of FIG. 1. However, for best effect amplifiers 60, 64 should have substantially linear gain characteristics and be as closely matched as possible. For these reasons, the embodiment of FIG. 1 is considered to present a better cost/function ratio and is preferred.

Figure 4:
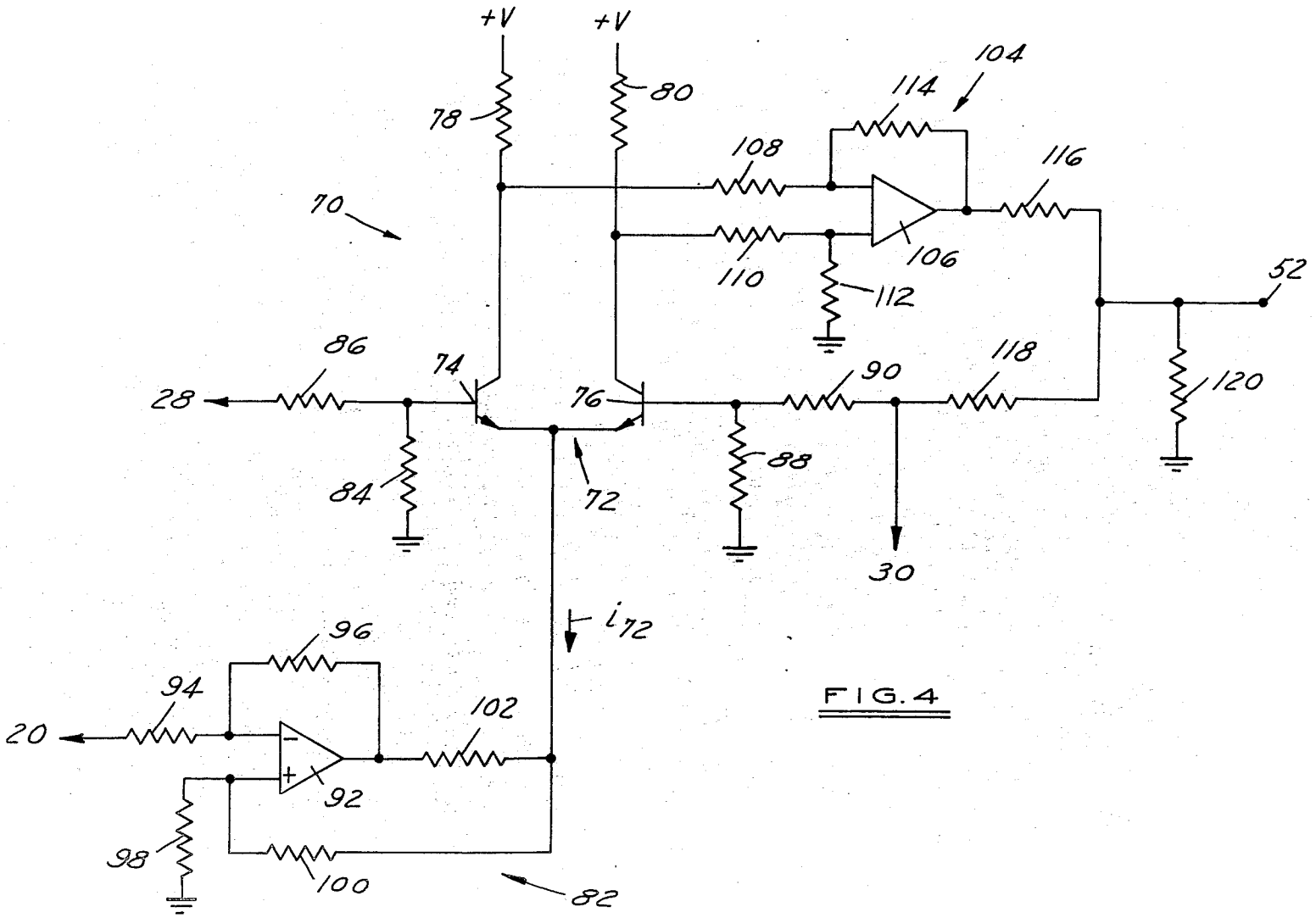
FIG. 4 is a schematic diagram of a modification to the embodiment of FIG. 3.

FIG. 4 is a schematic diagram of a modification to the embodiment of FIG. 3 wherein variable gain amplifiers 60, 64 and inverter 62 of FIG. 3 have been replaced by a single dual-input variable gain amplifier 72 which includes a pair of NPN transistors 74, 76 having their collectors connected to the positive voltage source through respective resistors 78, 80 and their emitters connected together to a reference current source 82. The base of transistor 74 is connected through a resistor 84 to ground and through a resistor 86 to the output of multiplexer 28 (FIG. 3). The base of transistor 76 is connected through a resistor 88 to ground and through a resistor 90 to the output of multiplexer 30 (FIG. 3). Current source 82 comprises an operational amplifier 92 having a negative input connected through a resistor 94 to output 20 of vibrato oscillator 14 (FIG. 3) and through a resistor 96 to the output of amplifier 92. The positive input to amplifier 92 is connected to ground through a resistor 98 and to the amplifier output through series resistors 100, 102. The junction of resistors 100, 102 is connected to the common emitter junction of transistors 74, 76.

A balanced-input differential amplifier 104 comprises an operational amplifier 106 having respective inputs connected to the collectors of transistors 74, 76 through resistors 108, 110. One input of amplifier 106 is also connected to ground through a resistor 112 while the other input is connected through a resistor 114 to the amplifier output. The ouput of amplifier 106 and the output of multiplexer 30 (FIG. 3) are connected through respective equal summing resistors 116, 118 to output terminal 52. A resistor 120 is connected from terminal 52 to ground. The impedance of resistor 120 is preferably equal to one-tenth of the impedance of each resistor 116, 118. The remaining circuit connections of oscillator 14, counter 24, adder 26 and multiplexers 28, 30, etc. are as shown in FIG. 3.

In the operation of the modification of FIG. 4, amplifier 72 operates as a standard differential amplifier having a gain linearly proportional to the common emitter reference current, indicated as $i_{72}$ in the drawing, and cooperates with balanced-input differential amplifier 104 to provide an output signal which is a linear function of the difference between the outputs of multiplexers 28, 30. The voltage output of balanced-input differential amplifier 104 is given by the equation:

$$v_{104} = k_1 i_{72} (v_{28} - v_{30}), \tag{1}$$

wherein $v_{28}$ and $v_{30}$ are the output voltages of multiplexers 28, 30 respectively and $k_1$ is a gain constant determined by the expression:

$$k_1 = 40\ (R2R3/R1 = R2), \tag{2}$$

where $R1$ is the impedance of resistors 86, 90, $R2$ the impedance of resistors 84, 86, $R3$ the impedance of resistors 78, 80, and the constant 40 is the standard engineering approximation for the gain of a differential amplifier at room temperature. Reference current $i_{72}$ is given by the equation:

$$i_{72} = k_2 v_{20}, \tag{3}$$

wherein $v_{20}$ is the voltage at vibrato oscillator output 20 and $k_2$ is a gain constant equal to the reciprocal of resistor 102 when resistors 94–100 are equal. Combining equations (1) and (3) and summing the outputs of multiplexer 30 and amplifier 104 through resistors 116, 118 yield at output terminal 52:

$$v_{52} = \frac{k_1 k_2 v_{20}}{10} (v_{28} - v_{30}) + v_{30}. \tag{4}$$

It will be recognized from equition (4) that, by making:

$$\frac{k_1 k_2 v_{20(max)}}{10} = 1, \tag{5}$$

the output voltage $v_{52}$ pans or blends smoothly from $v_{30}$ to $v_{28}$ as $v_{20}$ goes from zero to $v_{20(max)}$, i.e., when $v_{20} = 0$, $V_{52} = v_{30}$ and when $v_{20} = v_{20(max)}$, $v_{52} = v_{28}$.

It will be appreciated from the foregoing discussion that the system and method for securing vibrato and tremolo effects disclosed herein fully satisfies all of the objects and aims previously set forth. Although the invention has been disclosed in connection with three specific embodiments thereof, other modifications will be evident to the skilled artisan. Moreover, it will be appreciated that amplifier 70 has utility in other than the specific vibrato systems herein disclosed. For example, differential amplifier 72 and balanced amplifier 104 may be used without modification in the music recording industry for achieving a desired balance or blend between the signals from two microphones by selectively adjusting the gain of reference amplifier 82. Accordingly, the invention is intended to embrace all alternatives and modifications as fall within the following claims.

The invention claimed is:

1. In a method for producing vibrato and tremolo effects in electrical signals which includes the steps of receiving an input signal, injecting said signal into a multiple-segment delay line and scanning said delay line to produce an output signal, the improvement comprising the steps of separating said input signal into high and low frequency components and injecting said components into opposite ends of said delay line, randomness of signals scanned in said delay line being increased by varying delay and phase shift imparted to said frequency components by segments of said delay line.

2. The method set forth in claim 1 comprising the further step of terminating ends of said delay line in other than the characteristic impedance of said delay line such that standing wave patterns may develop in said delay line randomly to attenuate signals scanned in said delay line.

3. Apparatus for producing vibrato and tremolo effects in electrical signals comprising means for receiving an input signal, means for separating said input signal into high and low frequency component signals, multiple-segment delay means, means for injecting said high and low frequency component signals into opposite ends of said delay means, and means for sequentially scanning segments of said delay means to provide an output signal.

4. The apparatus set forth in claim 3 wherein said separating means comprises a frequency-selecting crossover network.

5. The apparatus set forth in claim 4 wherein the crossover frequency of said network is substantially equal to 750 hertz.

6. The apparatus set forth in claim 3 wherein said delay means has a characteristic impedance, said apparatus further comprising means terminating at least one end of said delay means in other than said characteristic impedance.

7. The apparatus set forth in claim 6 wherein said delay means comprises a multiple-segment delay line.

8. In an apparatus for producing vibrato effects in signals of the type which includes means for receiving an input signal, multiple-segment delay means connected to said receiving means and means for scanning segments of said delay means to provide an output signal, the improvement wherein said scanning means comprises analog multiplexer means connected to said delay means, means including a vibrato oscillator for providing a first signal having a symmetrical triangular waveform, means connected to said oscillator for addressing said multiplexer means to gate selectively signals at sequential delay means segments, and means for receiving said gated signals and responsive to said first signal to provide said output signal as a smooth transition between signals at successive segments of said delay means.

9. The apparatus set forth in claim 8 wherein said multiplexer means comprises first and second multiplexers having address inputs and having data inputs connected to said delay means, and wherein said addressing means comprises means connected to said address inputs and responsive to said vibrato oscillator to gate signals at successive segments of said delay means alternately through said first and second multiplexers.

10. The apparatus set forth in claim 9 wherein said delay means comprises an eight-segment delay line, and wherein said first and second multiplexers comprises respective eight-channel analog multiplexers.

11. The apparatus set forth in claim 9 wherein said addressing means comprises binary counter means responsive to an output of said vibrato oscillator to provide a first binary address signal, means responsive to an output of said vibrato oscillator for providing a second binary address signal equal to said first binary address signal plus a binary one, and means for connecting said first and second binary address signals to said multiplexer address inputs.

12. The apparatus set forth in claim 11 wherein said second address signal means comprises a binary adder having inputs connected to receive said first address signal.

13. The apparatus set forth in claim 9 wherein said means operatively connected to said multiplexer comprises a second oscillator for providing a high frequency signal, means responsive to said high frequency signal and said first signal to provide a sampling signal at the frequency of said high frequency signal and at a duty cycle controlled by said first signal, and means responsive to said sampling signal for gating signals at two successive segments of said delay means as complementary functions of said sampling signal to provide said output signal.

14. The apparatus set forth in claim 13 wherein said multiplexer means comprises first and second multiplexers, and wherein said means responsive to said sampling signals comprises switch gates at the outputs of said first and second multiplexers.

15. The apparatus set forth in claim 13 wherein said multiplexer means comprises first and second analog multiplexers having respective enabling inputs, said means responsive to said sampling signal comprising means to provide an inverted sampling signal and means for connecting said sampling signal and said inverted sampling signal to said enabling inputs of said first and second multiplexers respectively.

16. The apparatus set forth in claim 15 further comprising a low pass filter connected to receive said output signal.

17. The apparatus set forth in claim 13 wherein said high frequency signal has a frequency of substantially 75 kilohertz.

18. The apparatus set forth in claim 8 wherein said means operatively connected to said multiplexer means comprises variable gain amplifier means having a signal input connected to said multiplexer means and a gain control input responsive to said first signal.

19. The apparatus set forth in claim 18 wherein said multiplexer means comprises first and second analog multiplexers having respective multiplexer outputs, and wherein said amplifier means comprises first and second variable gain amplifiers having respective control inputs and respective signal inputs connected to said multiplexer outputs, means responsive to said first signal for providing an inverted first signal, and means for connecting said first signal and said inverted first signal to said control inputs of said first and second amplifiers respectively.

20. The apparatus set forth in claim 19 wherein said first and second amplifiers are substantially matched and have substantially linear gain.

21. The apparatus set forth in claim 18 wherein said multiplexer means comprises first and second analog multiplexers having respective multiplexer outputs, and wherein said amplifier means comprises differential amplifier means having first and second inputs respectively connected to said first and second multiplexer outputs and an output related to the difference between said first and second inputs, means responsive to said first signal for controlling the gain of said differential amplifier means, and means summing said output of said differential amplifier means with the output of one of said multiplexers, the output of said summing means blending smoothly from said first multiplexer output to said second multiplexer output as said first signal goes from zero to maximum.

22. The apparatus set forth in claim 21 wherein said means for controlling the gain of said differential amplifier comprises a controlled current source connected to provide a reference current to said differential amplifier means as a function of said first signal.

23. The apparatus set forth in claim 22 wherein said output of said summing means in volts is given by the expression:

$$\frac{k_1 k_2 v_{20}}{10}(v_{28} - v_{30}) + v_{30},$$

wherein $k_1$ is a gain constant for said differential amplifier means, $k_2$ is a gain constant of said controlled current source, $v_{20}$ is said first signal in volts, and $v_{28}$ and $v_{30}$ are said first and second multiplexer outputs in volts, and wherein:

$$\frac{k_1 k_2 v_{20(max)}}{10} = 1.$$

24. The apparatus set forth in claim 8 wherein said vibrato oscillator comprises a variable gain oscillator and means for selectively adjusting the vibrato frequency of said variable gain oscillator.

25. The apparatus set forth in claim 24 wherein said vibrato oscillator has an adjustable frequency in the range of zero to 100 hertz.

26. The apparatus set forth in claim 8 further comprising means for separating said input signal into high and low frequency component signals, and means for injecting said high and low frequency component signals into opposite ends of said delay means.

27. The apparatus set forth in claim 26 wherein said separating means comprises a frequency-selecting crossover network.

28. The apparatus set forth in claim 27 wherein the crossover frequency of said network is substantially equal to 750 hertz.

29. The apparatus set forth in claim 28 wherein said delay means has a characteristic impedance, said apparatus further comprising means terminating in at least one end of said delay means in other than said characteristic impedance.

30. The apparatus set forth in claim 29 wherein said delay means comprises a multiple-segment delay line.

31. A method for producing vibrato effects comprising the steps of receiving an electrical input signal, injecting said received input signal into a multiple-segment delay line, and scanning successive segments of said delay line to provide an output signal, said step of scanning said delay line comprising the steps of providing a periodic signal having a symmetrical triangular waveform and gating signals at two successive segments of said delay line as complementary functions of said periodic signal to provide said output signal as a smooth transition between said signals at said two successive segments.

32. The method set forth in claim 31 wherein said step of gating signals comprises the steps of providing a high frequency signal, modulating the duty cycle of said high frequency signal as a function of said periodic signal and gating signals at said two successive delay line segments as complementary functions of said duty cycle of said modulated high frequency signal.

33. The method set forth in claim 32 comprising the further set of filtering the effects of said high frequency signal from said output signal.

34. The method set forth in claim 31 wherein said step of gating signals comprises the step of amplifying signals at said two successive delay line segments as complementary functions of said periodic signal.

35. The method set forth in claim 31 comprising the further steps of separating said received input signal into high and low frequency components and injecting said components into opposite ends of said delay line, randomness of signals scanned in said delay line being increased by varying delay and phase shift imparted to said frequency components by segments of said delay line.

36. The method set forth in claim 35 comprising the further set of terminating ends of said delay line in other than the characteristic impedance of said delay line such that standing wave patterns may develop in said delay line randomly to attenuate signals scanned in said delay line.

37. An electronic amplifier comprising differential amplifier means having inputs to receive first and second signals and an output related to the difference between said first and second signals, means responsive to a third signal for selectively controlling the gain of said differential amplifier means as a linear function of said third signal, and means summing said output of said differential amplifier means with one of said first and second signals, the output of said summing means being a linear function of the difference between said first and second signal and balancing said first and second signals at a ratio which is a function of said third signal, the output of said summing means being given by the expression:

$$\frac{k_1 k_2 v_{20}}{10}(v_{28} - v_{30}) + v_{30},$$

wherein $k_1$ is the gain constant for said differential amplifier means, $k_2$ is the gain constant for said means for selectively controlling the gain of said differential amplifier means, $v_{20}$ is said third signal, and $v_{28}$ and $v_{30}$ are said first and second signals respectively, and wherein:

$$\frac{k_1 k_2 v_{20(max)}}{10} = 1.$$

38. In apparatus for producing vibrato effects in signals the combination which includes an electronic amplifier comprising differential amplifier means having inputs to receive first and second signals and an output related to the difference between said first and second signals, means responsive to a third signal for selectively controlling the gain of said differential amplifier means, and means summing said output of said differential amplifier means with one of said first and second signals, the output of said summing means balancing said first and second signals at a ratio which is a function of said third signal; means for receiving an input signal; multiple-segment delay means connected to said receiving means; and means for providing said first and second signals from successive segments of said delay means; said combination further comprising a vibrato oscillator for providing said third signal having a symmetrical triangular waveform, said output of said summing means being a smooth transition between said signals at said successive segments of said delay means.

39. The amplifier set forth in claim 37 wherein said means for controlling the gain of said differential amplifier comprises a controlled current source connected to provide a reference current to said differential amplifier means as a function of said first signal.

40. The amplifier set forth in claim 37 in apparatus for producing vibrato effects in signals in combination with means for receiving an input signal, multiple-segment delay means connected to said receiving means and means for providing said first and second from successive segments of said delay means, said apparatus further comprising a vibrato oscillator for providing said third signal having a symmetrical triangular waveform, said output of said summing means being a smooth transition between said signals at said successive segments of said delay means.

41. The apparatus set forth in claim 37 further comprising means for receiving said first signal and means for phase shifting said first signal to provide said second signal.

* * * * *

UNITED STATES PATENT AND TRADEMARK OFFICE

CERTIFICATE OF CORRECTION

PATENT NO. : 4,114,499

DATED : September 19, 1978

INVENTOR(S) : Eric von Valtier

It is certified that error appears in the above-identified patent and that said Letters Patent are hereby corrected as shown below:

Column 3, line 48, "intput" should be -- input --.

Column 6, line 18 (equation 2), "R1=R2" should be

-- R1 + R2 --.

Column 10, Claim 33, Line 2, "set" should be -- step --.

Column 10, Claim 36, Line 2, "set" should be -- step --.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*